US008646540B2

(12) United States Patent
Eckholm et al.

(10) Patent No.: US 8,646,540 B2
(45) Date of Patent: Feb. 11, 2014

(54) METHODS AND APPARATUS FOR PASSIVE NON-ELECTRICAL DUAL STAGE FIRE SUPPRESSION

(75) Inventors: William A. Eckholm, Scottsdale, AZ (US); Brian J. Cashion, Gilbert, AZ (US); Dustin C. Moran, Glendale, AZ (US)

(73) Assignee: Firetrace USA, LLC, Scottsdale, AZ (US)

( * ) Notice: Subject to any disclaimer, the term of this patent is extended or adjusted under 35 U.S.C. 154(b) by 299 days.

(21) Appl. No.: 12/839,593

(22) Filed: Jul. 20, 2010

(65) Prior Publication Data

US 2012/0018177 A1 Jan. 26, 2012

(51) Int. Cl.
*A62C 35/58* (2006.01)

(52) U.S. Cl.
USPC ..... 169/85; 169/56; 169/60; 169/71; 239/304

(58) Field of Classification Search
USPC ..... 169/30, 42, 56–61, 71, 77, 85; 239/304
See application file for complete search history.

(56) References Cited

U.S. PATENT DOCUMENTS

| | | | | |
|---|---|---|---|---|
| 1,931,230 | A | 10/1933 | Laengel | |
| 2,471,241 | A | 5/1949 | Rider | |
| 2,692,649 | A * | 10/1954 | McCreary | 169/57 |
| 2,871,952 | A | 2/1959 | Doak | |
| 3,292,709 | A | 12/1966 | Hodgman | |
| 3,884,304 | A | 5/1975 | Messirschmidt | |
| 4,082,148 | A | 4/1978 | Williams | |
| 4,597,451 | A | 7/1986 | Moore et al. | |
| 4,830,116 | A | 5/1989 | Walden et al. | |
| 6,095,251 | A | 8/2000 | Mitchell et al. | |
| 6,871,802 | B2 | 3/2005 | Stilwell et al. | |
| 6,955,226 | B2 * | 10/2005 | Akins et al. | 169/19 |
| 7,066,274 | B2 | 6/2006 | Lazzarin | |
| 7,172,031 | B2 * | 2/2007 | Piatti | 169/9 |
| 7,712,542 | B2 * | 5/2010 | Munroe | 169/14 |
| 2007/0114046 | A1 * | 5/2007 | Munroe | 169/16 |
| 2009/0071664 | A1 | 3/2009 | Sitabkhan | |

* cited by examiner

*Primary Examiner* — Christopher Kim
(74) *Attorney, Agent, or Firm* — The Noblitt Group, PLLC

(57) ABSTRACT

Methods and apparatus for passive non-electrical dual stage fire suppression according to various aspects of the present invention include detecting a fire with a first active fire suppressant unit and changing the status of a second fire suppressant unit from "stand-by" to "active" when the first fire suppressant unit releases a fire suppressant agent. After the first fire suppressant unit has released its fire suppressant agent, the second fire suppressant unit may detect a continued and/or a new fire and release a second fire suppressant agent in response to the detection.

7 Claims, 3 Drawing Sheets

METHODS AND APPARATUS FOR PASSIVE NON-ELECTRICAL DUAL STAGE FIRE SUPPRESSION

GOVERNMENTAL RIGHTS

The United States Government may have rights in this as provided under Contract FA9201-09-C-0154 awarded by the United States Air Force.

BACKGROUND OF INVENTION

Fire suppression systems are common in many of today's structures and to some extent in many vehicles. The type of system used is often dependent on the application and/or the type of hazard that is to be addressed. Some fire suppression systems also incorporate redundancy to protect against system failure. However, redundant systems are often merely just an increase in one or more of the same components in a system. The reasoning for this is that the probability of both systems failing simultaneously is much less than the probability of failure for a single system. However, redundant systems comprising multiple system components can add cost and each system may be subject to the same type of failure mode.

Redundancy in fire suppression systems has also been accomplished by combining systems that operate independently of each other. For example, an electrically controlled system may be backed up by a pneumatic system that is not subject to electrical failure. Although potentially better in some applications, redundancy performed in this manner results in two different active systems which can also increase cost and complexity.

SUMMARY OF THE INVENTION

Methods and apparatus for passive non-electrical dual stage fire suppression according to various aspects of the present invention include detecting a fire with a first active fire suppressant unit and changing the status of a second fire suppressant unit from "stand-by" to "active" when the first fire suppressant unit releases a fire suppressant agent. After the first fire suppressant unit has released its fire suppressant agent, the second fire suppressant unit may detect a continued and/or a new fire and release a second fire suppressant agent in response to the detection.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described herein in terms of functional block components and various processing steps. Such functional blocks may be realized by any number of hardware or software components configured to perform the specified functions and achieve the various results. For example, the present invention may employ various housings, panels, connectors, sensors, and the like, which may carry out a variety of functions. In addition, the present invention may be practiced in conjunction with any number of structures, buildings, containers, and/or vehicles such as trucks, fixed wing aircraft, and rotorcraft, and the system described is merely one exemplary application for the invention. Further, the present invention may employ any number of conventional techniques for suppressing fire, sensing environmental conditions, and the like.

Methods and apparatus for passive non-electrical dual stage fire suppression system according to various aspects of the present invention may operate in conjunction with any suitable mobile and/or stationary application. Various representative implementations of the present invention may be applied to any system for suppressing fires. Certain representative implementations may include, for example, buildings, vehicles, cargo bays, fuel tanks, and/or storage tanks.

Figure 1:
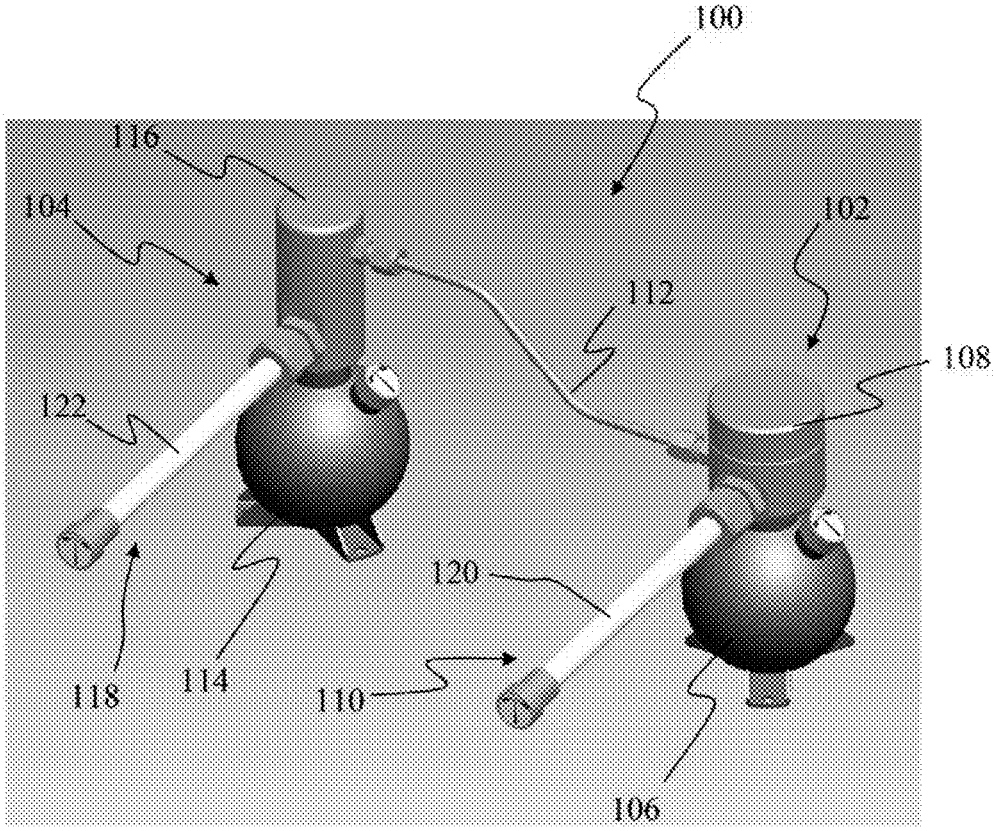
FIG. 1 representatively illustrates a fire suppression system in accordance with an exemplary embodiment of the present invention.

Referring to FIG. 1, in one embodiment, methods and apparatus for a passive non-electrical dual stage fire suppression system 100 may comprise a first fire suppression unit 102 configured to release a first fire suppressant agent. The first suppression unit 102 may also be configured to generate a signal upon release of the first suppressant agent for causing a second fire suppression unit 104 to change from a standby state to an active state. The first fire suppression unit 102 may also be coupled to the second fire suppression unit 104 by a link 112 adapted to transmit the signal generated by the first fire suppression unit 102 to the second fire suppression unit 104.

The first and second fire suppression units 102, 104 may be located in an area where protection from a fire is desired. The first and second fire suppression units 102, 104 may comprise any suitable system for suppressing a developing and/or existing fire. For example, referring to FIG. 1, in one embodiment, the first fire suppression unit 102 may comprise a first housing 106 for containing the first fire suppressant agent. The first fire suppression unit 102 may further comprise a first fire detection unit 110 and a first valve 108 connected to the first housing 106, wherein the first valve 108 is responsive to the first fire detection unit 110. The first housing 106 may also be suitably adapted to release the first fire suppression agent in response to the first fire detection unit 110 sensing a fire and subsequently activating the first valve 108.

Similarly, the second fire suppression unit 104 may comprise a second housing 114 containing a second fire suppression agent, a second valve 116, and a second fire detection unit 118. The second fire suppression unit 104 may be held in "standby" mode until after the first fire suppression unit 102 has been activated and the first fire suppression agent has been released.

The first and second housings 106, 114 each contain a fire suppression agent until a fire is detected and the respective fire suppression agent is needed. The first and second housings 106, 114 may comprise any suitable system for holding a volume of fire suppression agent such as a pressurized vessel, a cylinder, a tank, a bladder, and the like. The first and second housings 106, 114 may be suitably configured to contain a mass or volume of any suitable hazard control material such as a liquid, gas, solid material, and/or combination of materials. The first and second housings 106, 114 may also comprise any suitable material for a given application such as metal, plastic, and/or composite material. For example, each housing 106, 114 may comprise a material adapted to withstand temperatures associated with either direct or indirect exposure to a fire.

The first and second housings 106, 114 may also be suitably adapted to be pressurized greater than the surrounding environment. For example, in one embodiment, the first housing 106 may comprise a pressurized pneumatic bottle that is formed from an appropriate metal and is suitably adapted to contain the first fire suppression agent under pressure until the fire is detected and the first valve 108 is activated. The second housing 114 may comprise a cylinder that is unpressurized during a standby mode but is configured to be pressurized in response to activation of the first valve 108.

In one embodiment, the first and second housings 106, 114 may be configured to be pressurized up to about 360 pounds per square inch (psi). In a second embodiment, the first and second housings 106, 114 may be configured to be pressurized up to about 800-850 psi. Alternatively, the first and second housing 106, 114 may be configured to be pressurized at different levels. For example, each housing 106, 114 may be adapted to be pressurized according to the type of fire suppression agent inside of each respective housing 106, 114. In another embodiment, each housing 106, 114 may be pressurized according to factors such as the type of pressurizing gas used, the type of valve connected to the housing, and/or a desired release rate of the respective fire suppressant agent.

The first and second valves 108, 116 may help seal the respective fire suppression agents in their respective housing 106, 114. The first and second valves 108, 116 may also control the pressure inside of the housings 106, 114 and/or control the release of the fire suppression agents. For example, the first valve 108 may connect to the first housing 106 in such a manner as to maintain the pressure inside of the first housing 106 and to prevent the release of the first fire suppressant agent until the valve 108 is activated.

The first and second valves 108, 116 may comprise any suitable system for maintaining the volumes of first and second fire suppression agents and for releasing the volumes upon demand. For example, the valves 108, 116 may comprise any suitable type of valve such as a ball valve, gate valve, pressure differential valve or burst disc type valve, and the like. For example, in one embodiment, the first valve 108 may comprise a sealing element fitted to the first housing 106 that is adapted to be punctured or otherwise compromised to cause the first housing 106 to depressurize, allowing the first fire suppressant agent to escape. The first and second valves 108, 116 may also be responsive to a signal from the first and second fire detection units 110, 118 and be suitably adapted to activate in response to the signal.

The first and second valves 108, 116 may also be configured to operate by any suitable method such as pneumatically, mechanically, and/or the like. For example, in one embodiment, the first valve 108 may comprise a pressure differential valve that is held in a closed position by a larger force applied to the top of the piston than the bottom due to a larger surface area on top of the piston than on the bottom. A change in pressure on one side of the pressure differential valve may result in the piston moving from a closed position to an open position, thereby allowing the first fire suppression agent in the first housing 106 to be released.

The first and second valves 108, 116 may also be configured to operate individually from each other. For example, the first valve 108 may be configured to release the first fire suppression agent when activated and the second valve 116 may be configured to pressurize and seal the second housing 114 upon activation of the first valve 108.

Referring now to the first fire suppression unit 102, once the first valve 108 has been activated, the volume of the first fire suppression agent may be delivered in any suitable manner to combat the fire. For example, the first valve 108 may be configured to control the release of and/or the rate of release of the first fire suppressant agent by being suitably configured to selectively control the manner in which the first fire suppressant agent is allowed to exit the first housing 106. In one embodiment, the first valve 108 may comprise a selectively sized opening that is configured to release a predetermined mass flow rate of the first fire suppression agent. The rate of release of the first fire suppression agent may be dependent on any suitable factor such as a given application, installation location, type of fire suppressant agent, and/or may be related to the pressure within the first housing 106.

For example, in one embodiment, the first valve 108 may have an opening of a size suitable to allow substantially instant depressurization the first housing 106. The substantially instant depressurization may deliver the first fire suppression agent to a surrounding environment over a relatively short period of time, such as, on the order of 0.1 seconds. In another embodiment, the first valve 108 may be configured to have an opening allowing the first housing 106 to depressurize over a longer period of time, such as about sixty seconds, thereby extending the amount of time that the first fire suppressant agent is released into the surrounding environment. In yet another embodiment, the rate at which the first valve 108 releases the first fire suppression agent may depend in part on the initial pressure differential between the pressure inside of the first housing 106 and a surrounding ambient environment.

The first valve 108 may also provide a signal upon activation that may be used to cause a pressurization of the second fire suppression unit 104. The first valve 108 may create the signal by any suitable method. For example, in one embodiment, the first valve 108 may be suitably configured to route a portion of the released pressure from the first housing 106 to the second fire suppression unit 104 through the link 112.

Referring now to the second fire suppression unit 104, the second valve 116 may be configured to activate in response to receiving the signal from the link 112. Activation of the second valve 116 may also alter the state of the second fire suppression unit 104 from a standby mode to an active mode. For example, the second valve 116 may be suitably configured to pressurize the second housing 114 to then maintain the second fire suppressant agent under a higher pressure than before the activation of the second valve 116. The second valve 116 may also be configured to release the then pressurized second fire suppressant agent by any suitable method after a fire is detected by the second fire detection unit 118. In one embodiment, the second valve 116 may be configured to regulate the release of the second fire suppressant agent in a similar manner as that used by the first valve 108. In another embodiment, the second valve 116 may be configured to control the release of the second fire suppressant agent in a manner appropriate for the type of fire suppressant agent held within the second housing 114.

Figure 2:
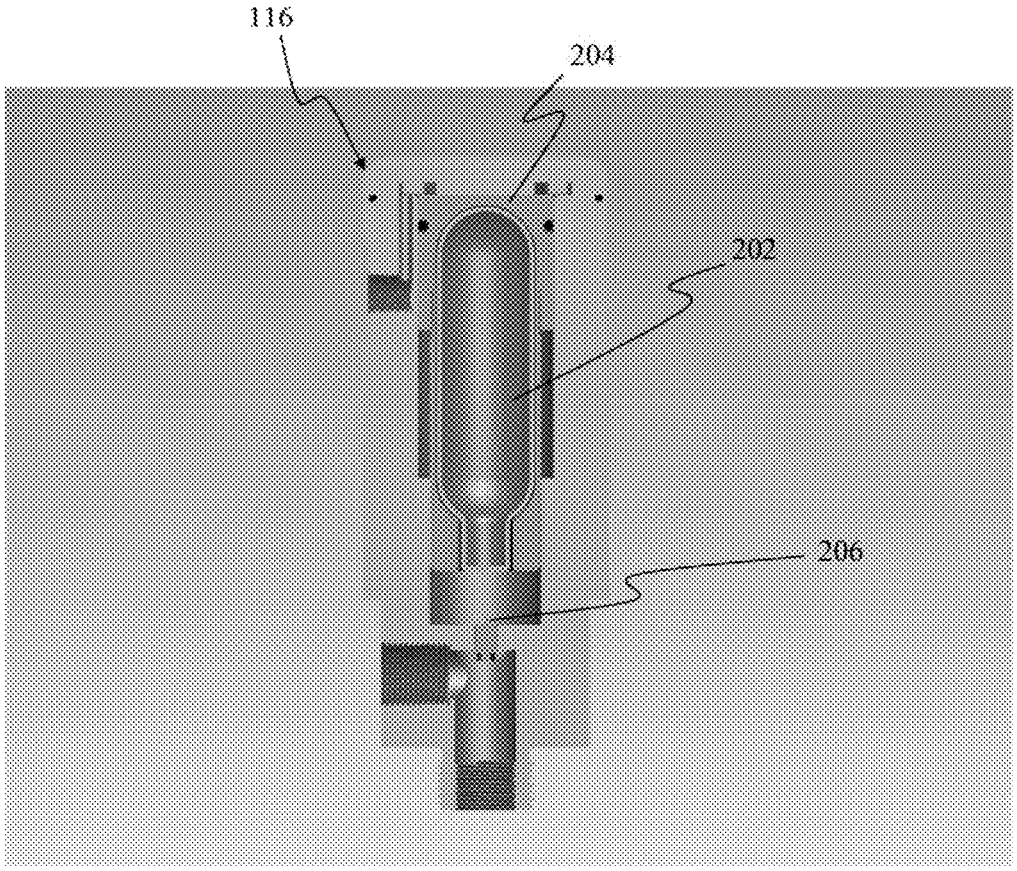
FIG. 2 representatively illustrates a piston cylinder and a gas cartridge.

The second valve may also be configured to pressurize the second housing 114 by any suitable method such as injecting a gas into the second housing 114 or compressing an existing gas within the second housing 114 to a higher pressure. Referring now to FIG. 2, in one embodiment, the second valve 116 may further comprise a pressure vessel 202, such as a pressurized gas cartridge, and a piston 204 configured to rupture the pressure vessel 202 in response to the signal received from the link 112 causing a pressurized gas to enter the second housing 114.

In another embodiment, the second valve 116 may further comprise a piston 204, a puncture pin 206, and a burst disc. For example, the piston 204 may be configured to move in response to an applied force on the piston 204 from the portion of the pressure discharged from the first housing 106. The movement of the piston 204 may cause the puncture pin 206 to puncture the burst disc. Once the burst disc has been compromised, a gas contained within the burst disc may be released into the second housing 114 thereby pressurizing it.

The first and second fire detection units 110, 118 sense the fire and activate their respective valve assemblies. The first and second fire detection units 110, 118 may also act as a delivery system for the respective fire suppression agents contained within the housing. The first and second fire detection units 110, 118 may individually comprise any suitable system for detecting a tire such as an infrared detector, a shock sensor, a thermocouple, a pressure gauge, a temperature sensitive element, or a linear pneumatic heat sensor. The fire detection units 110, 118 may also be configured of any suitable material such as metal, plastic, or a polymer. The fire detection units 110, 118 may also be suitably adapted to withstand elevated temperatures and/or pressures up to a predetermined level. Referring again to FIG. 1, in one embodiment, the first fire detection unit 110 may comprise a heat sensitive pressure tube 120 that is suitably configured to provide a conduit path for the first fire suppressant agent from the first housing 106 to the location where the fire has been detected.

The heat sensitive pressure 120 tube may be configured such that the integrity of the tube is compromised when the beat sensitive pressure tube 120 is subjected to elevated temperatures associated with a fire. For example, the heat sensitive pressure tube 120 may comprise a material that is adapted to degrade and/or rupture when subjected to elevated temperatures. The heat sensitive pressure tube 120 may also be pressurized and/or be configured to withstand pressures of up to 800 psi. For example, in one embodiment, the heat sensitive pressure tube 120 may comprise a plastic pressurized tube, wherein the plastic is adapted to rupture and depressurize in response to an applied heat load such as direct exposure to a fire.

Referring again to the first fire suppression unit 102, the heat sensitive pressure tube 120 of the first fire detection unit 110 may comprise a pressurized length of tubing sealed on one end and connected to the first valve 108 on the other end. The heat sensitive pressure tube 120 may be held at the same pressure as the pressure inside the first housing 106 or it may be held at some other pressure and be configured to rupture and/or burst when subjected to a predetermined temperature and/or direct exposure to flames. Once the integrity of the heat sensitive pressure tube 120 has been compromised, the change in pressure of the heat sensitive pressure tube 120 may cause the first valve 108 to activate and begin releasing the first fire suppressant material through the first fire detection unit 110 to the location where the rupture occurred. The heat sensitive pressure tube 122 of the second fire detection unit 118 may be configured in the same manner as the heat sensitive pressure tube 120 of the first fire detection unit 110.

In another embodiment, the heat sensitive pressure tubes 120, 122 of the first and second fire suppression units 102, 104 may comprise a pressurized length of tubing sealed on one end and connected to the respective first or second valve 108, 116 on the other end and be filled with a gas held at a first pressure. The heat sensitive pressure tubes 120, 122 may be configured to at least temporarily withstand elevated temperatures such that if one or both of the heat sensitive pressure tubes 120, 122 are subjected to increased temperatures the pressure of the gas inside the respective heat sensitive pressure tubes 120, 122 is increased. The first and second valves 108, 116 may be configured to activate in response to the pressure of the gas exceeding a predetermined threshold. Upon activation of one of the valves 108, 116, the respective fire suppressant material may be routed through the heat sensitive pressure tubes 120, 122 and released by any suitable method such as through one or more nozzles connected to the heat sensitive pressure tubes 120, 122, through scored sections in the heat sensitive pressure tubes 120, 122 configured to open and/or rupture in response to the threshold pressure, or through an opening in the heat sensitive pressure tubes 120, 122 resulting from direct exposure to an open flame.

The first and second fire detection units 110, 118 may be substantially co-located such that a fire may cause each heat sensitive pressure tube 120, 122 to rupture prior to the activation of the first valve 108. Although the heat sensitive pressure tube 122 of the second fire detection unit 118 may be ruptured prior to the activation of the second valve and/or the pressurization of the second housing 114, the second fire suppressant agent may not be released until after the second housing 114 has been pressurized. This may be due to the type of fire suppressant agent contained within the second housing 114. For example, a dry powder fire suppressant agent may remain within the second housing 114 despite a ruptured heat sensitive pressure tube 122 in the second fire detection unit 118 because there is no active force or pressure acting on the dry powder to disturb it from the second housing 114. However, upon an increase in pressure to the second housing 114, the dry powder may be mixed into the incoming pressurized gas and be carried with the gas as it moves towards the location of the rupture in the heat sensitive pressure tube 122.

The link 112 transmits the signal generated by the first fire suppression unit 102 to the second fire suppression unit 104. The link 112 may comprise any suitable system for transmitting a signal such as a pneumatic tube or a mechanical linkage. The link 112 may also comprise any suitable material such as metal, polymer, and/or a composite material that is adapted to withstand elevated temperatures associated with proximity to a fire and/or direct exposure to flames. For example, the link 112 may comprise a material that can withstand temperatures greater than those tolerated by the fire detection units 110, 118 such that the integrity of the link 112 is maintained even after a pressure tube has ruptured.

For example, in one embodiment, the link 112 may comprise a length of metallic tubing suitably configured to withstand pressurization with a gas and/or a portion of the pressurized first fire suppression agent from the first fire suppression unit 102. In one embodiment, the pressurized gas from the first fire suppression unit 102 may enter the link 112 through a first end connected to the first valve 108 and proceed through the length of the tube to a second end connected to either the second valve 116 or the second fire suppression unit 104. Once the pressurized gas reaches the second end of the link 112, it may be used to trigger and/or change the state of the second fire suppression unit 104 from a standby state to an active state.

The dual-stage fire suppression system 100 may comprise one or more hazard control materials such as fire suppressants, caustic neutralizing agents, and/or displacing gasses. The first and second fire suppressant agents may comprise any suitable agent for suppressing and/or extinguishing a fire such as dry powders, liquids, inert gases, granular materials, and the like. For example, in one embodiment, the first fire suppressant agent may be suitably adapted for transient events such as explosions or other rapid combustion events and the second fire suppressant agent may comprise a fire suppressant suitably adapted to suppress latent fires or other less rapidly developing fires. In another embodiment, the first and second hazard control materials may comprise the same materials.

The first and second fire suppressant agents may also be kept under pressure or dispersed within a given volume. For example, the first fire suppressant agent may be substantially equally dispersed under pressure within the first housing 106 while is second fire suppressant agent may be maintained under substantially ambient pressure until after the activation of the second valve 116.

The manner in which each fire suppressant agent is maintained prior to the existence of a fire may also determine the types of fire suppressant agent that may be contained within the first and second housings 106, 114. For example, the alternating state of the second fire suppression unit 104 may require the use of a powder type fire suppressant agent as opposed to a liquid or pressurized gas.

Figure 3:
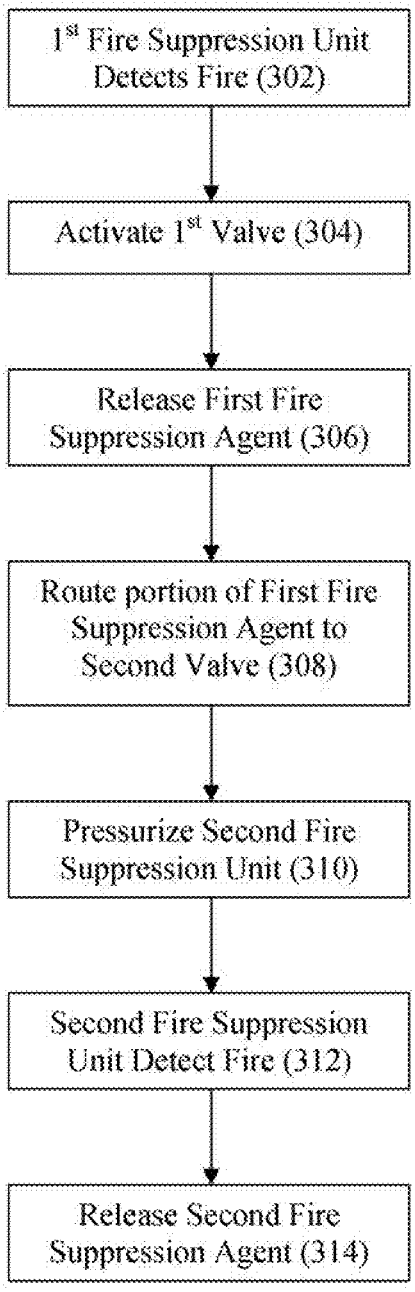
FIG. 3 representatively illustrates a flow chart illustrating a method for delivering the first and second fire suppressants in accordance with an exemplary embodiment of the present invention.

In operation, a dual-stage fire suppression system 100 is installed at least proximate to a location deemed in need of fire protection. A first active fire suppression unit is linked to a second standby fire suppression unit. Referring now to FIGS. 1 and 3, a first fire suppression unit 102 may comprise a first housing 106, a first valve 108, and a first fire detection unit 110. The first housing 106 may contain a first fire suppressant agent under a higher pressure relative to the surrounding ambient environment. If the first fire detection unit 110 detects a fire (302) the first valve is activated (304) causing the release of the first fire suppressant (306) from the first housing 106. The first fire detection unit 110 may also comprise a delivery system for the first fire suppressant agent. For example, the first fire detection unit 110 may comprise a heat sensitive pressure tube that activates the first valve 108 in response to a depressurization of the pressure tube caused by a rupturing of the pressure tube in at least one location. The released first fire suppressant agent may then be routed through the first valve 108 to the pressure tube such that the first fire suppressant agent exits the pressure tube at the location of the rupture(s).

The first valve 108 may also be configured to route a portion of the released pressurized first fire suppressant agent through a link 112 to a second valve 116 of the second fire suppression unit 104 (308). The routed first fire suppressant agent may then cause the second valve 116 to activate causing the second fire suppression unit 104 to pressurize a second housing 114 that contains a second fire suppressant agent (310).

After the second housing 114 has been pressurized, the state of the second fire suppression unit 104 may change from standby to active. Subsequently, if a second fire detection unit 118 detects a fire (312) the second valve 116 may be activated to effect the release of the second fire suppressant agent (314) in a similar manner as that of the first fire suppressant agent.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A dual-stage fire suppressant system for protecting a surrounding environment from a fire, comprising:

a first fire suppression unit comprising:

a first housing configured to contain a first fire suppression agent;

a first valve connected to the first housing and configured to:

maintain the first fire suppressant agent under pressure in the first housing;

release the pressure in the first vessel to distribute the first fire suppression agent in response to a fire detection signal; and a first heat sensitive pressure tube connected to the first valve, wherein the first heat sensitive pressure tube is configured to create the fire detection signal in response to an applied heat load;

a pneumatic tube having a first end connected to the first valve, wherein the pneumatic tube is configured to route a portion of the released first fire suppressant from the first end to a second end of the pneumatic tube; and a second fire suppression unit linked to the first fire suppression unit, wherein the second fire suppression unit comprises:

a second housing containing a second fire suppression agent;

a second valve connected to the second housing and the second end of the pneumatic tube, wherein the second valve is configured to:

pressurize the second housing with a second gas in response to a detection of the released first fire suppressant at the second end of the pneumatic tube; and release the pressure in the second housing to distribute the first fire suppression agent in response to a second fire detection signal; and a second heat sensitive pressure tube connected to the second valve, wherein the second heat sensitive pressure tube is configured to create the second fire detection signal.

2. A dual-stage fire suppressant system according to claim 1, wherein the first heat sensitive pressure tube is further configured to:

be filled with a gas and held under a first pressure;

rupture in response to an applied heat load causing the gas to exceed a predetermined threshold, wherein the rupture causes a pressure loss creating the fire detection signal; and distribute the first fire suppressant agent released from the first housing.

3. A dual-stage fire suppressant system according to claim 1, wherein the second heat sensitive pressure tube is further configured to:

be pressurized with the second gas substantially simultaneously with the second housing;

rupture in response to an applied heat load to create the second fire detection signal; and distribute the second fire suppressant agent released from the second housing.

4. A dual-stage fire suppressant system according to claim 3, wherein the second heat sensitive tube is configured to rupture in response to the second gas to exceeding a predetermined threshold.

5. A dual-stage fire suppressant system according to claim 1, wherein the second valve further comprises a sealed pressure vessel containing a compressed gas, wherein the pressure vessel is configured to release the compressed gas into the second housing and the second heat sensitive pressure tube in response to the detection of the released first fire suppressant at the second end of the pneumatic tube to thereby pressurize the second housing.

6. A dual-stage fire suppressant system according to claim 5, wherein the pressure vessel comprises at least one of a gas cartridge and a burst disc.

7. A dual-stage fire suppressant system according to claim 5, wherein the second valve is further configured to compromise the integrity of the pressure vessel to facilitate the release of the compressed gas into the second housing.

* * * * *